US006029983A

United States Patent [19]

Wegener

[11] Patent Number: 6,029,983

[45] Date of Patent: Feb. 29, 2000

[54] BACKSLIDE PLATE

[75] Inventor: Andreas Wegener, Waldering, Germany

[73] Assignee: Sunshine Distribution, Inc., Vista, Calif.

[21] Appl. No.: 08/834,523

[22] Filed: Apr. 4, 1997

[30] Foreign Application Priority Data

Jul. 12, 1996 [DE] Germany ..... 296 12 211 U

[51] Int. Cl.[7] ..... A63C 17/06

[52] U.S. Cl. ..... 280/11.22; 280/811

[58] Field of Search ..... 280/11.22, 11.2, 280/11.12, 11.19, 11.3, 11.32, 809, 811, 7.13; 36/115; D21/224, 225, 226

[56] References Cited

U.S. PATENT DOCUMENTS

| | | | |
|---|---|---|---|
| 250,319 | 11/1881 | Yates | 280/11.22 |
| 4,273,345 | 6/1981 | Ben-Dor et al. | 280/11.2 |
| 4,928,982 | 5/1990 | Logan | 280/11.22 |
| 5,183,276 | 2/1993 | Pratt | 280/11.22 |
| 5,234,230 | 8/1993 | Crane et al. | 280/811 |
| 5,327,329 | 7/1994 | Stiles | 362/61 |
| 5,411,278 | 5/1995 | Wittmann | 280/11.22 |
| 5,456,478 | 10/1995 | Hsu et al. | 280/11.22 |
| 5,566,958 | 10/1996 | Sinelnikov et al. | 280/11.22 |
| 5,772,220 | 6/1998 | Gaster | 280/7.1 |
| 5,806,860 | 9/1998 | Conte | 280/11.22 |
| 5,836,591 | 11/1998 | Roderick et al. | 280/11.22 |

*Primary Examiner*—Paul N. Dickson
*Assistant Examiner*—Bridget Avery
*Attorney, Agent, or Firm*—Brown, Martin, Haller & McClain, LLP

[57] ABSTRACT

An in-line roller skate has a replaceable slider at the especially exposed areas of the shoe to protect the shoe from wear. The slider is very inexpensive and can be replaced after it has been worn out, and its replacement can even be carried out by nonprofessionals. The slider is preferably shaped in such a way that the shoe in the sliding area is covered completely by the slider, so that it no longer comes into contact with the ground or railings.

10 Claims, 2 Drawing Sheets

BACKSLIDE PLATE

BACKGROUND OF THE INVENTION

The present invention relates to a single-track roller skate of the type generally known as "in-line skates." Such skates distinguish themselves in that they have four to five wheels arranged one after the other in the running direction, that is, in one line, which are mounted on a chassis so that they can be rotated, whereby this chassis is firmly connected with the sole of a shoe or is in part even integrated into the sole of the shoe. A skate of this type is illustrated, for example, in patent publications EP 0 656 220 and DE-GM 78 20 544.

The chassis, on which the wheels are mounted, in the well known in-line skates consists of a U-shaped frame, whose center leg is attached to the sole and whose free legs stand out perpendicular from the sole of the shoe and accommodate the wheels between them. The chassis and the wheels are thereby clearly narrower than the width of the shoe sole so that the sole extends out over the side of the chassis.

With the so-called extreme or stunt skates on in-line skates there are maneuvers, so-called royals or backslides, in which the rider slides along on a railing, curbstone edge or something similar and thereby also uses the outside of the upper shoe as sliding surface. Because of this sliding, the shoe is worn out very quickly and becomes unusable in a very short time.

The object of the innovation is to improve the single-track roller skate of the above-cited type in such as way that it has better durability and consequently longer service life even under extreme stresses.

This task is solved by the present invention in the manner described below.

SUMMARY OF THE INVENTION

The basic principle of the invention consists of placing a replaceable slider at the especially exposed areas of the shoe to protect the shoe from wear.

This slider is very inexpensive and can be replaced after it has been worn out, and its replacement can even be carried out by nonprofessionals.

The slider is preferably shaped in such a way that the shoe in the sliding area is covered completely by the slider, so that it no longer comes into contact with the ground or railings.

The slider is preferably made rounded or angled on the external side so that it provides additional guidance for the shoe during sliding.

The slider extends only over approximately one-third of the length of the shoe and is installed approximately in the center area of the shoe and extends from the heel area of the sole, which amounts to approximately 20% of the entire length, up to the tip and ball area of the shoe, which amounts to approximately 45% of the entire length.

The slider is preferably made of plastic or nonferrous metal, for example, aluminum.

According to an improvement of the innovation, the slider is installed only on the inner side facing the other foot because this side is especially stressed. According to another improvement of the invention, the slider can, however, also be installed on both sides. In this case the sliders can also be connected with each other as one piece where a web passing through under the sole connects both of these parts with each other. Finally the sliders are preferably screwed on to the sole.

BRIEF DESCRIPTION OF THE DRAWINGS

In the following, the innovation will be explained in more detail by means of a practical example in connection with the drawings, in which.

DESCRIPTION OF A PREFERRED EMBODIMENT

Figure 1:
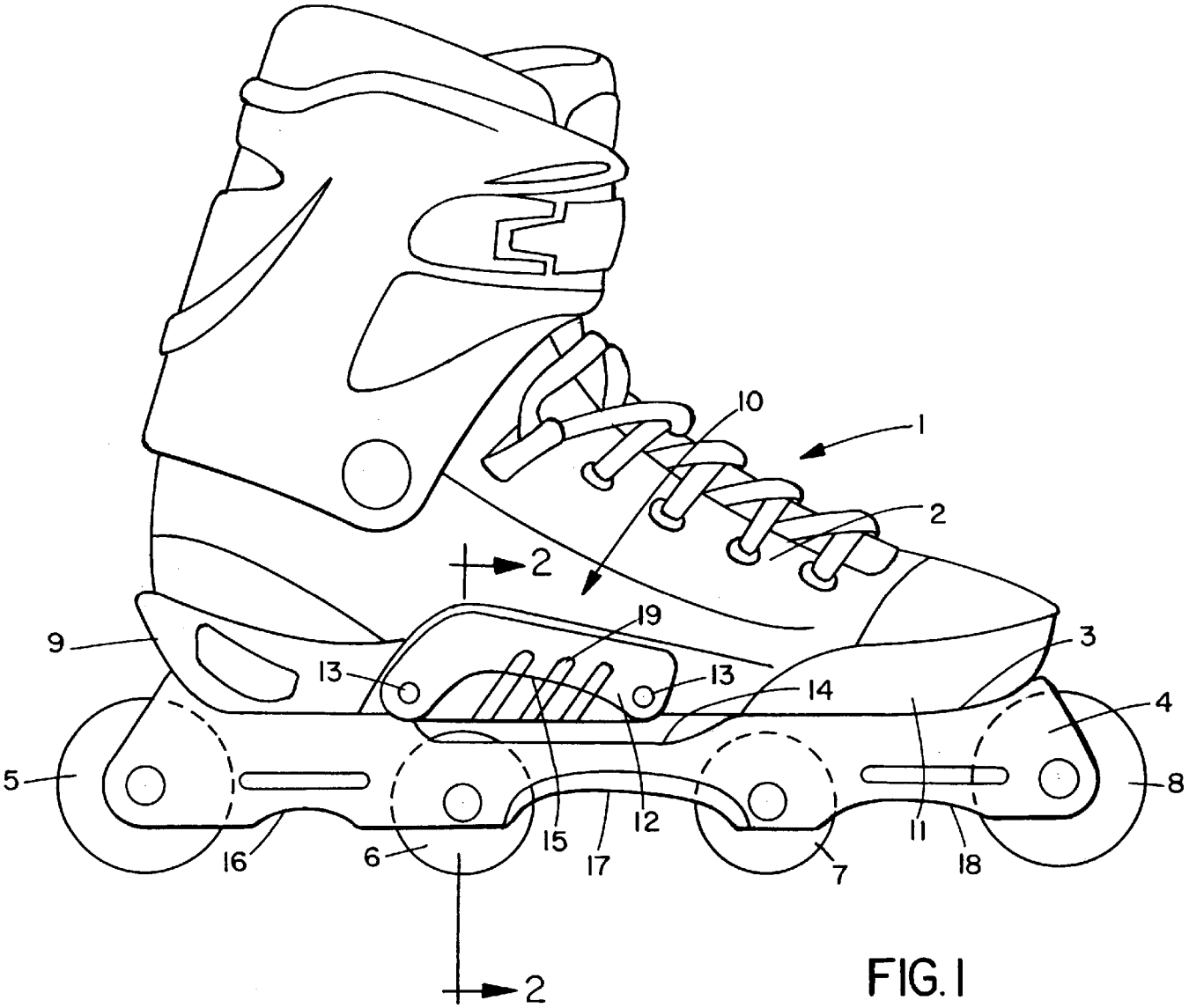
FIG. 1 shows a side view of the internal side facing the other foot of a single-track roller skate according to the innovation.

The single-track roller skate 1 has a shoe upper part 2, on the sole 3 of which a chassis 4 is attached, on which four wheels 5, 6, 7 and 8 are mounted rotatably. The bottom side of the sole is here essentially flat and thus lies predominantly in one plane. The sole 3 has a heel area 9, which extends over approximately 20% of the length of the sole, a center area 10 connected to the heel, in which center area the arch of the foot lies and finally a point or ball area 11. In the extreme maneuvers mentioned at the beginning, especially the center area 10 of the shoe is stressed because the rider slides along railings and curbstone edges with this center area or touches the ground with this area. According to the innovation, in this center area 10 a replaceable slider 12 has been attached, which snuggles up to the outside contour of the shoe 2 and consequently protects the center area 10. The slider 12 is removably attached to the shoe 2 by means of screws 13 and can consequently easily be replaced. This slider 12 is preferably made of plastic and therefore has a low weight. However, it would also be possible to make it of metal, for example, aluminum, steel or something similar.

In the area of the slider 12, the chassis 4 has a recess 14, which makes it possible for the slider 12 to also be directed further under the sole 3 and makes it possible to introduce through this recess 14 a single-piece slider, which is pulled up on the side on both sides of the shoe.

The slider 12 has an arch 15, which during sliding down on a railing or some other edge gives additional guidance. The chassis 4 in the areas between adjacent wheels also has a lower edge arched upwards, which in this area also forms guides 16, 17 and 18.

Finally, it can also be seen from FIG. 1 that the slider has several grooves 19 running at an angle from the bottom upward, which also serve as guides during sliding.

Figure 2:
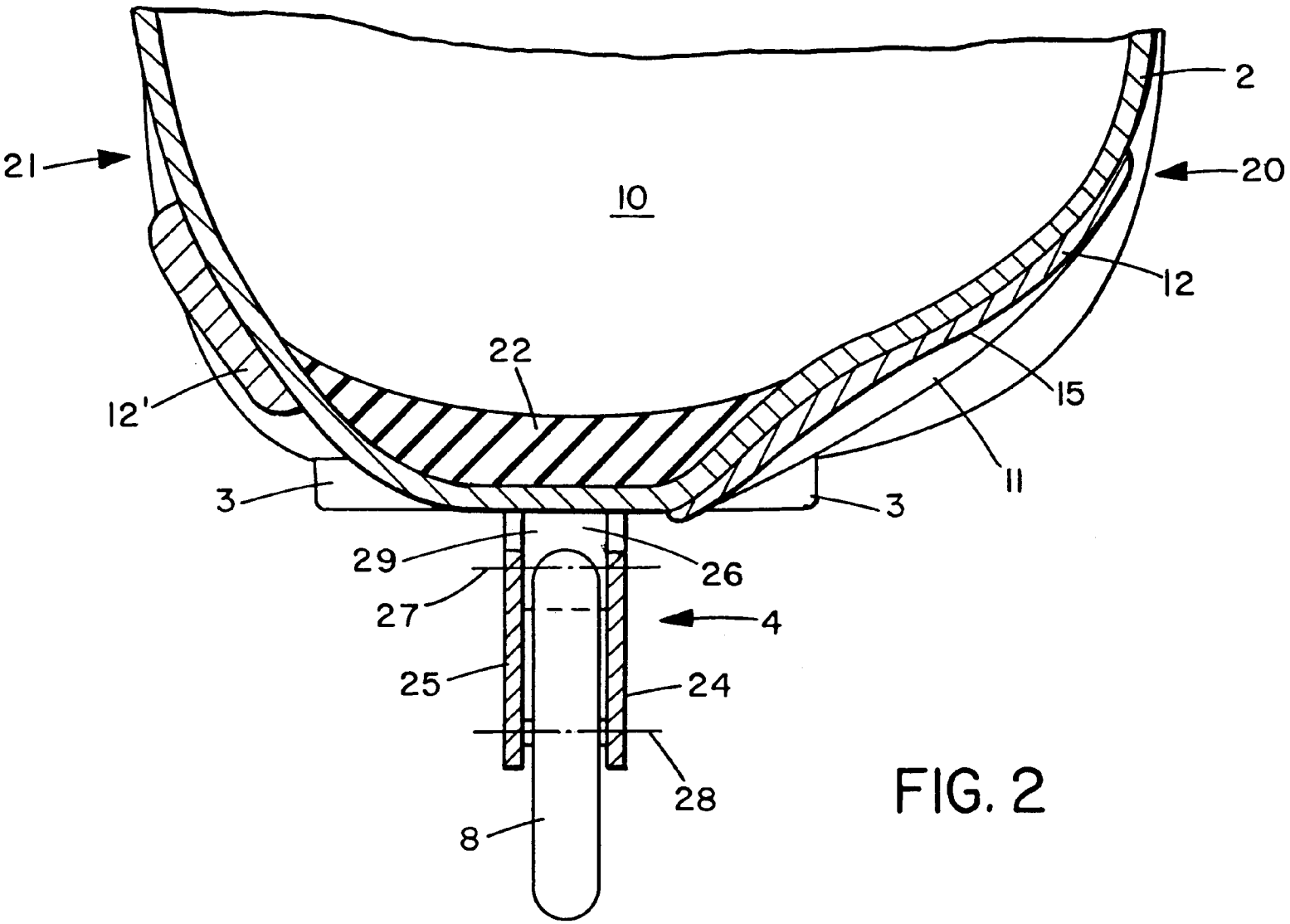
FIG. 2 shows a cross section of the shoe in FIG. 1 taken along the line a—a of FIG. 1.

FIG. 2 shows a section along the line a—a of FIG. 1. In this drawing 20 refers to the internal side and 21 refers to the external side of the shoe 2. Consequently it involves the left shoe, in which the internal side faces the right shoe. On the especially stressed internal side the slider 12 has been placed, which is matched to the external contour of the shoe 2 in the center area 10 (FIG. 1) and exhibits the arch 15, which serves for guidance of the slider on objects such as railings.

On the section drawing in FIG. 2 it can be seen that the center area 10 (FIG. 1) is offset inward with respect to the forefoot 11, which then also results in the recess 15. Furthermore, FIG. 2 shows better how the chassis 4 is attached to the sole 3. The chassis consists of two replaceable sidewalls 24 and 25, which are screwed on to a projection 26 extending vertically from the sole 3. The screw is indicated by the dashed line 27. The wheel 8 has been mounted rotatably between the two sidewalls 24 and 25, whereby this bearing is indicated by the dashed line 28. In the center area 10 the chassis 4 is lowered down with respect to the bottom side of the sole 3, whereby a free space 29 results, which has already been explained in detail above.

Furthermore, it can be seen that the sole also lies in a plane with the sole of the front part 11 in the center area 10 and that padding 22 has been provided in this center area.

In the practical example in FIG. 2 a slider 12' has also been installed on the external side 21 of the shoe, which protects this area. As already mentioned above, both sliders 12 and 12' can also be made as one piece and can extend through the free space 29 between the bottom side of the sole 3 and the chassis 4.

With the innovation the shoe is thus on the one hand protected from rapid wear and, in addition, its function is also improved by the shape of the slider, in that for certain maneuvers it obtains guidance through the shape of the slider. The sliders can easily be replaced and can be obtained as inexpensive spare parts.

What is claimed is:

1. A single-track roller skate with a chassis, on which several wheels lying one after the other in a row have been arranged rotatably, whereby the chassis is firmly connected with the sole of a shoe, characterized in that a substantially plate shaped, one piece replaceable slider made of a rigid material has been attached on at least one external side of the shoe in its center area, a portion of the slider extending from the side of the shoe to below the sole of the shoe.

2. A single-track roller skate according to claim 1, characterized in that the slider is shaped in such a way that it completely covers those side parts of the shoe which during riding come into contact with the ground or a railing, a curbstone edge, or something similar.

3. A single-track roller skate according to claim 2, characterized in that the slider in the longitudinal direction of the shoe exhibits an arch extending inward, which forms additional guidance for the shoe during sliding on a railing, or something similar.

4. A single-track roller skate according to claim 3, characterized in that the slider extends over approximately one-third of the length of the shoe and is attached in the center area of the shoe, in which the sole of the foot has an arch.

5. A single-track roller skate according to claim 4, characterized in that the slider is made of plastic.

6. A single-track roller skate according to claim 4, characterized in that the slider consists of nonferrous metal, for example, aluminum, or of steel plate.

7. A single-track roller skate according to one of claim 6, characterized in that the slider is only attached on the internal side of the shoe facing the other foot.

8. A single-track roller skate according to claim 6, characterized in that the slider is attached on both sides of the shoe.

9. A single-track roller skate according to claim 8, characterized in that the sliders attached on both sides of the shoe are connected with each other by means of a web, which runs through below the sole of the shoe.

10. A single-track roller skate according to claim 7, characterized in that the sliders are screwed on to the shoe and/or the sole.

* * * * *